US005665512A

United States Patent [19]

Tsutsui et al.

[11] Patent Number: 5,665,512

[45] Date of Patent: Sep. 9, 1997

[54] MONO-COMPONENT TONER FOR DEVELOPING AN ELECTROSTATIC LATENT IMAGE AND DEVELOPING METHOD

[75] Inventors: Chikara Tsutsui, Nishinomiya; Hiroyuki Fukuda, Kobe; Junju Machida, Toyonaka, all of Japan

[73] Assignee: Minolta Co., Ltd., Osaka, Japan

[21] Appl. No.: 551,561

[22] Filed: Nov. 1, 1995

[30] Foreign Application Priority Data

Nov. 2, 1994 [JP] Japan ..... 6-269897
Nov. 2, 1994 [JP] Japan ..... 6-269898

[51] Int. Cl.[6] ..... G03G 9/097

[52] U.S. Cl. ..... 430/110; 430/903

[58] Field of Search ..... 430/110, 903

[56] References Cited

U.S. PATENT DOCUMENTS

| | | | |
|---|---|---|---|
| 4,206,064 | 6/1980 | Kiuchi et al. | 430/106 |
| 4,433,040 | 2/1984 | Niimura et al. | 430/109 |
| 4,791,882 | 12/1988 | Enoguchi et al. | 118/653 |
| 4,826,749 | 5/1989 | Kawagishi et al. | 430/110 |
| 4,833,057 | 5/1989 | Misawa et al. | 430/109 |
| 4,863,824 | 9/1989 | Uchida et al. | 430/109 |
| 4,980,258 | 12/1990 | Aoki et al. | 430/110 |
| 5,069,994 | 12/1991 | Gitzel et al. | 430/110 |
| 5,168,028 | 12/1992 | Nanya et al. | 430/110 |
| 5,189,476 | 2/1993 | Anno et al. | 355/259 |
| 5,234,788 | 8/1993 | Morimoto et al. | 430/106.6 |
| 5,304,449 | 4/1994 | Hollenbaugh | 430/110 |
| 5,429,900 | 7/1995 | Asanae et al. | 430/110 X |

*Primary Examiner*—Roland Martin
*Attorney, Agent, or Firm*—McDermott, Will & Emery

[57] ABSTRACT

A mono-component toner comprises binder resin; a colorant; first charge controlling agent that has an amount of solubility between 10% and 50% by weight with respect to toluene; and a second charge control agent that includes nitrogen atom.

42 Claims, 1 Drawing Sheet

MONO-COMPONENT TONER FOR DEVELOPING AN ELECTROSTATIC LATENT IMAGE AND DEVELOPING METHOD

BACKGROUND OF THE INVENTION

1. Field of the Invention

The present invention relates to a mono-component toner for developing an electrostatic latent image by electrophotographic, electrostatic recording, and electrostatic printing methods, and developing method for same.

2. Description of the Related Art

Development of electrostatic latent images by electrophotographic, electrostatic recording, and electrostatic printing methods is accomplished by electrostatically adhering triboelectrically charged toner to an electrostatic latent image formed on the surface of a photosensitive member so as to render said latent image visible.

Two-component developing method using a two-component developer comprising a magnetic carrier and a toner, and mono-component developing method using mono-component developer comprising a toner without a carrier are well-known as electrostatic latent image developing methods of the aforesaid types.

Magnetic mono-component toners which contain magnetic particles and non-magnetic mono component toners which do not contain magnetic particles are well known as toners used in mono-component developing methods.

Mono-component developers are more difficult to attain a specific toner charge than are two-component developers.

In two-component developers, for example, mixing which charges the toner by mixing the toner and carrier at suitable times to attain stable charge by adequately assuring contact and circulation of the toner and carrier.

In mono-component developers, on the other hand, a toner regulating member is arranged so as to make contact with a developing sleeve, and the mono-component toner is triboelectrically charged by passing between said toner regulating member and said developing sleeve, and the charged toner is maintained on the surface of the developing sleeve by electrostatic force so as to be transported to a developing region to develop an electrostatic latent image formed on the surface of a latent image-bearing member. Uniform charging of the toner to a specific charge amount is difficult inasmuch as the charge attained by the momentary passage between the developing sleeve and the toner regulating member cannot be assured. When the toner charge is low, not only is the amount of the toner charge reduced, but reverse charged toner may result with the result that toner adheres to the non-image portion of the latent image-bearing member, thereby causing fogging of the obtained image. Conversely, when the toner charge is excessive, toner is electrostatically retained on the developing sleeve, thereby reducing image density due to the reduced amount of toner particles adhering to the latent image, and further reducing transfer efficiency due to the increased electrostatic force relative to the latent image-bearing member. These disadvantages are particularly serious in the case of producing ever finer toner particles in response to demands for increased image quality, and in the case of triboelectric charging of toner under high temperature and high humidity conditions.

In the previously mentioned mono-component developing devices, toner is subjected to mechanical stress when it passes between the toner regulating member and the developing sleeve. Thus, a disadvantage arises inasmuch as toner readily tends to become anchored to the toner regulating member. When toner becomes anchored to the toner regulating member, less toner is transported to the developing region which is observable as white streaks on the developing sleeve. This type of toner retention irregular distribution of the toner on the developing sleeve, and causes inadequate charging by the toner regulating member.

Although toner toughness or heat resistance can be improved to prevent the aforesaid toner retention and anchoring, simply improving toughness on heat resistance leads to offset by the heating roller, and reduced fixing hardness.

An example of a mono-component developing device is disclosed in U.S. patent application Ser. No. 5,189,476 pertaining to a developing device provided with a developing sleeve including whiskers. The developing sleeve provided with whiskers in the aforesaid disclosure has excellent wear resistance, toner transportability, and toner chargeability. Particularly when a small size non-magnetic mono-component toner is used in a developing method using the aforesaid developing sleeve, the charge rise becomes unstable, and a high load is exerted by the whiskers on the toner, such that image density is reduced and transfer efficiency is reduced until a saturation charge is attained.

SUMMARY OF THE INVENTION

An object of the present invention is to provide a mono-component toner or mono-component developing method using said toner which eliminates the previously described disadvantages.

Another object of the present invention is to-provide a mono-component toner or mono-component developing method having excellent triboelectric chargeability.

Another object of the present invention is to provide a mono-component toner or mono-component developing method having excellent triboelectric chargeability, and which does-not cause image fog or image density reduction and remains stable under high temperature and high humidity environmental conditions.

Yet another object of the present invention is to provide a mono-component toner or mono component developing method which causes negligible toner retention on the toner regulating member due to triboelectric charging.

A further object of the present invention is to provide a mono-component toner or mono-component developing method using same having excellent heat resistance as well as offset resistance or fixing strength.

A still further object of the present invention is to provide a mono-component toner or developing method having excellent charge rise in a mono-component developing method using whiskers in a mono-component developing device or a mono-component toner used in said developing method.

An even further object of the present invention is to provide a mono-component toner or developing method having a saturation charge within a suitable range in a mono-component developing method including whiskers in a mono-component developing device or mono-component toner used in said developing method.

Figure 1:
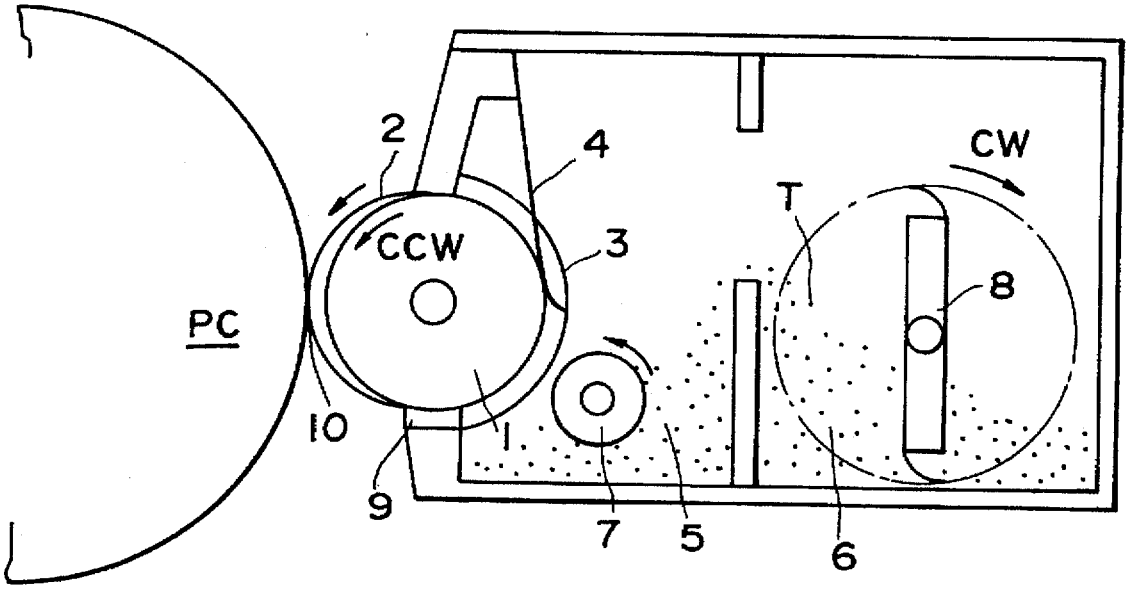
FIG. 1 is a brief section view showing a developing device using an embodiment of the mono-component developing method of the present invention.

Specific features of the present invention will become apparent from the following description of the preferred embodiments taken in conjunction with the accompanying drawings.

DETAILED DESCRIPTION OF THE PREFERRED EMBODIMENTS

The present embodiment of the invention is a mono-component toner for use in a developing method provided with a toner regulating member arranged so as to be in contact with a developing sleeve, wherein said toner is charged by passing between said developing sleeve and said toner regulating member. This toner contains binding resin, colorant, and charge control agent. A negative charge control agent a having a solubility of 10% to 50% by weight with respect to toluene, and a charge control agent b of at least one type among the following formulae (A) and (B).

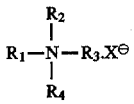

(A)

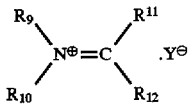

(B)

[Wherein R1–R4 is selected from the group consisting of hydrogen, fluoride alkyl group having carbon atoms. of 1–69 and fluorine atoms of 3–66 and fluoride alkenyl group having carbon atoms of 1–69 and fluorine atoms of 3–66, said fluoride alkyl group and fluoride alkenyl group being unsubstituted or substituted by substituent being selected from the group consisting of hydroxyl group, chloromethyl group, carboxyl amide group, sulfonic amide group, urethane group, amine group, R5—O—R6 group and R7—C(O)—R8 wherein R5–R8 is alkyl group having carbon atoms of 1–30, wherein X— represents organic anion or inorganic anion, wherein R9–R12 is selected from the group consisting of hydrogen, fluoride alkyl group having carbon atoms of 1–69 and fluorine atoms of 3–66 and fluoride alkenyl group having carbon atoms of 1–69 and fluorine atoms of 3–66, said fluoride alkyl group and fluoride alkenyl group being unsubstituted or substituted by substituent being selected from the group consisting of hydroxyl group, chloromethyl group, carboxyl amide group, sulfonic amide group, urethane group, amine group, R5—O—R6 group and R7—C(O)—R8, wherein Y— represents organic anion or inorganic anion.]

In general, charge control agent is added to the toner to improve toner chargeability. Typically, toner is manufactured by fusion kneading constituents such as binder resin, colorant, charge control agent, and anti-offset agent as necessary, then pulverizing and classifying the kneaded material. Various materials are known as charge control agents, and have various characteristics regarding compatibility to the binder resin during the aforesaid fusion-kneading process. Compatibility of the charge control agent with respect to the binder resin can be expressed by the solubility with respect to a solvent having a phenyl group such as toluene when using a polyester resin as a binder resin because monomers are included which have hydroxyl groups as structural monomers.

In the present invention, solubility of the charge control agent with respect to toluene is specified by the following equation from the residual amount remaining after 1 g of charge control agent is introduced into 100 cc of toluene, mixed for 30 min at 50° C., and subsequently filtered whereupon the residual amount remaining after drying is measured.

Solubility (percent-by-weight)=[((wt. of charge control agent)−(wt. of filtered charge control agent))/(wt. of charge control agent)] ×100

When a charge control agent is used that is insoluble in the binder resin, i.e., when using a charge control agent having a solubility of less than 10% with respect to toluene, the obtained toner has a structure wherein the charge control agent is dispersed as fine particles within the toner and a part of said charge control agent is exposed on the surface of the toner. It is believed that the charge control agent exposed on the surface of the toner provides a strong charge point and is mainly responsible for the toner charge. In such a case, when the charge control agent is insufficiently dispersed in the binder resin during the fusion-kneading process, there arises a discrepancy between the amount of exposed charge control agent on the surface of the toner and the content amount of each toner particle, thereby producing low charge toner and toner having an opposite charge. When a small amount of charge control agent is added to the toner, the aforesaid discrepancy readily occurs, such that an adequate amount of charge control agent must be added to assure sufficient toner charging. This problem is particularly pronounced when very fine toner particles are used.

On the other hand, when a charge control agent is used which has high solubility relative to the binder resin, i.e., when a charge control agent is used which has a solubility greater than 50 percent-by-weight with respect to toluene, the obtained toner is in a state wherein the charge control agent is completely compatible wit the binder resin, such that the charge control agent is thinly present in the binder resin throughout the toner. Thus, the charge control agent content of each toner particle readily attains uniformity, but the toner charge rise is adversely affected, thereby causing a further disadvantage in that sufficient toner charge cannot be assured.

From this perspective, it is desirable that the charge control agent used in the toner should have a certain degree of compatibility with respect to the binder resin without being completely compatible. Therefore, the charge control agent desirably has a solubility of 10~50 percent-by-weight with respect to toluene, and a solubility of 15~30 percent-by-weight is preferable.

When such a charge control agent is used in a toner having a volume average particle size of 5~9 μm in a mono component developing method, the specific surface area increases in conjunction with the smaller particle size, such that the toner charge becomes excessive under low humidity conditions, leading to reduced image density and transfer efficiency. This situation is believed to have a great effect of toner particle size on chargeability in mono-component developing method compared to two-component developing methods because the toner is charged by passing trough a contact region between a developing sleeve and a toner regulating member.

In the preferred embodiments of the present invention, a negative charge control agent having a predetermined solubility with respect to the binder resin is added in combination with a specific charge control agent. The aforesaid problem of excessively high toner charge can b eliminated, particularly when two kinds of charge control agents are used in combination in non-magnetic mono-component toner having volume average particle size of 5~9 μm, so as to eliminate the problem of image fog which accompanies the occurrence of opposite charged toner.

In the present invention, charge control agents having, for example, the general structural formula of (C) or (D) may be used as a negative charge control agent having a predetermined solubility relative to the binder resin, i.e., a 10~50 percent-by-weight solubility with respect to toluene.

(C)

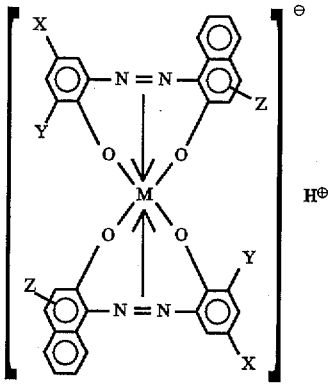

[wherein X represents nitro group, sulfonic amide group or halogen atom, Y represents hydrogen atom halogen atom or nitro group, Z represents hydrogen atom or carbamoyl group and M represents chloro atom or cobalt atom.]

(D)

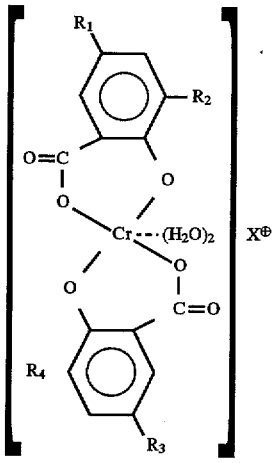

[wherein R1–R4 represents hydrogen atom or alkyl atom, and X+ represents counter ion.]

Examples of useful charge control agents expressed by structural formula (C) above include S-34 (Oriental Chemical Industries, Ltd.), TRH (Hodogaya Chemicals, Ltd.), T-95 (Hodogaya Chemicals, Ltd.) and the like. Examples of useful charge control agents expressed by structural formula (D) above include E-81 (Oriental Chemicals, Ltd.) and the like.

The aforesaid various problems are eliminated when the charge control agent b expressed by the previously mentioned formulae (A) and (B) are used in combination with negative charge control agent a having a predetermined solubility with respect to toluene. This effect is though to originate in the fact that the aforesaid charge control agent b has a structure containing a quaternary ammonium salt structure with positive charge properties and a group having fluoro atoms with negative charge properties.

An example of a useful charge control agent having the structure (A) is VP-434 (Hecht, Inc.)

Specific examples of charge control agents having the structures of formulae (A)and (B) are described in compounds (1)~(11) below.

(1)

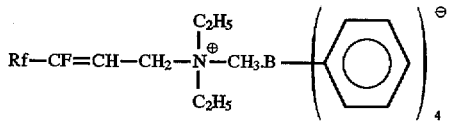

$Rf = C_5F_{11} - C_{11}F_{23}$ (2)

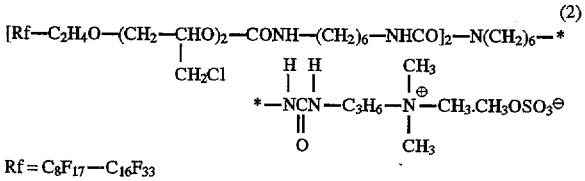

$Rf = C_8F_{17} - C_{16}F_{33}$ (3)

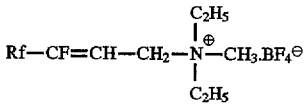

$Rf = C_5H_{11} - C_{11}F_{23}$ (4)

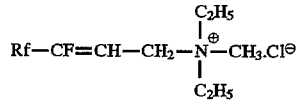

$Rf = C_5F_{11} - C_{11}F_{23}$ (5)

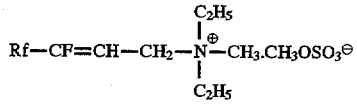

$Rf = C_5F_{11} - C_{11}F_{23}$ (6)

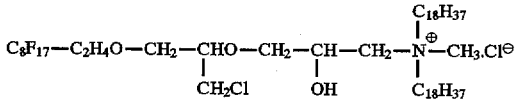

(7)

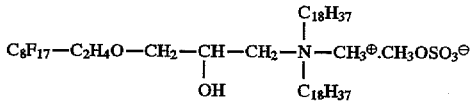

(8)

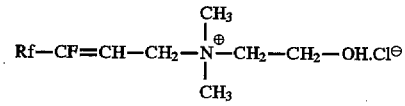

$Rf = C_3F_7 - C_{16}F_{33}$ (9)

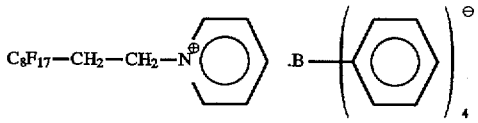

(10)

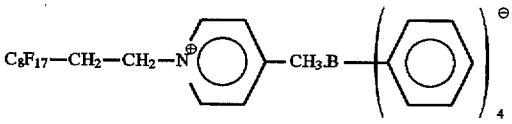

(11)

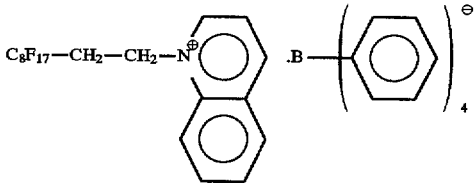

In the present invention, a larger amount of charge control agent a is added than charge control agent b, such that the total amount of added charge control-agent is 1~7 parksby-weight, and preferably 1.5~5 parts-by-weight per 100 parts-by-weight of binder resin. Excellent charge stability and uniformity can be attained and the amount of charge controlled to a predetermined amount in a mono-component toner having fine particle size by adding specific quantities and ratios of negative charge control agent a and charge control agent b. Furthermore, charge stability can be improved with respect to environmental fluctuations (e.g. high temperature, high humidity conditions to low temperature, low humidity conditions). When the total amount of added charge control agent is less than 1 part-by-weight, it is difficult to attain sufficient toner charge, whereas when the total amount added exceeds 7 parts-by-weight, the cost becomes excessive and the influence of the negative charge control agent become stronger so as to make it difficult to adequately eliminate reduced image density.

The resin used as the toner binder resin in the present invention is-preferably a polyester resin having a glass transition point Tg of 58°~75° C., softening point of 110°~170° C., contains constituents insoluble in methyl-ethyl-ketone in the amount of 10~40 percent-by-weight, and has an acid value 10~40 KOHmg/g.

In the mono-component developing method, a blade like toner regulating member presses against a developing sleeve as previously described, to form a thin layer of charged toner on the surface of the developing sleeve as the toner passes therebetween (regulating region). Since the toner is triboelectrically charged through contact with the developing sleeve and regulating member in the regulating region, the thickness of the toner layer must be sufficiently thin in the regulating region to allow adequate charge to be imparted to the toner. That is, when the toner layer is too thick, adequate charge is not obtained due to the mutual contact of toner particles, resulting in opposite charge toner. A toner regulating member must press against the surface of the developing sleeve in order to form a thin toner layer, but this force applied by the regulating member also applies stress on the toner. This stress causes retention of the toner on the regulating member and developing sleeve in the toner regulating region. When toner is retained, the thin toner layer formed on the surface of the developing sleeve is disturbed, thereby reducing the chargeability of toner in the toner regulating region, so as to produce insufficiently charged toner. Accordingly, the toner used in the mono-component developing method preferably satisfies, in addition to the aforesaid charging characteristics, both characteristics of toughness so as to prevent toner retention on the toner regulating member and developing sleeve, and heating characteristics producing excellent fixing properties, and both said characteristics can be satisfied by using the previously described specific polyester resins. That is, when the glass transition point is lower than 58° C. or the-softening temperature is lower than 110° C., the heat resistance of the obtained toner is reduced, and toner is readily retained in the toner regulating region. When the glass transition temperature is higher than 75° C. or the softening point is higher than 70° C., toner fixing characteristics are adversely affected. When the amount insoluble in methyl-ethyl-ketone is greater than 40 percent-by-weight, toner fixing characteristics deteriorate, and when the amount is less than 10 percent-by-weight, toner toughness is inadequate. When the acid value exceeds 40 KOHmg/g, charge stability is readily susceptible to environmental fluctuations, and when the acid value is less than 10 percent-by-weight, dispersion of the colorant and the like is reduced.

In the present invention, the glass transition point is expressed as a value measured by a differential scanning calorimeter (DSC), and the softening point is expressed as a value measured by a flow tester. The amount of constituent insoluble in methyl-ethyl-ketone is expressed as a value obtained by introducing 3 g of resin into 100 ml of methyl-ethyl-ketone and mixing for 24 hrs, filtering the solution using a 500-mesh filter coated uniformly with 5 g of zeolite filtration agent, drying the filter for 1 day and night in a vacuum, and measuring the weight of the residual constituent remaining on the filter.

The aforesaid polyester resin will preferably contain a polyester resin having a linear polyester resin and a urethane bond. In this case, thermal characteristics such as fixing properties and the like are assured by the linear polyester resin, and wear resistance and toughness are assured by the polyester resin having a urethane bond.

The linear polyester resin comprises at least ether diphenol and aromatic dicarboxylic acid.

Examples of useful ether diphenol include ethoxy or propoxy ether diphenol, e.g., bisphenol A ethylene oxide compounds, bisphenol A propylene oxide compounds.

Examples of useful aromatic dicarboxylic acid include phthalic acid, and anhydrides thereof, terephthalic acid, isophthatic acid, and esters thereof.

A dicarboxylic acid resins may be used in the linear polyester, e.g., dibasic acid resins such as malonic acid, succinic acid, glutaric acid, adipic acid, azelaic acid, sebacic acid, and unsaturated dibasic acid resins such as maleic acid, maleic acid anhydride, fumaric acid, itaconic acid, citraconic acid and the like. Diol resins may also be used, e.g., saturated or unsaturated glycol resins such as ethylene glycol, 1,2,-propylene glycol, 1,3,-butylene glycol, 1,4-butylene glycol, 1,6-hexane diol, neopentyl glycol, dethylene glycol, dipropylene glycol, triethylene glycol and the like.

The linear polyester resin may be produced by mixing at least the aforesaid diphenyl ether and aromatic carboxylic acid resin in a COOH/OH ratio of 1.1~1.4, using typical methods such as high-temperature polycondensation, liquid polycondensation, or surface polycondensation methods. The linear polyester resin used will have a weight-average molecular weight Mw of 5,000~12,000, glass transition temperature of 60°~80° C., acid value of 45 KOHmg/g, or less. When the weight-average molecular weight is less than 5,000, the toughness of the ultimately obtained binder resin becomes problematic, whereas when the weight-average molecular weight exceeds 12,000, the toner fixing strength decreases. When the glass transition temperature is higher than 80° C., toner fixing characteristics are reduced, whereas when said temperature is lower than 60° C., toner heat resistance is adversely affected. When the acid value is higher than 45, moisture resistance becomes problematic.

Polyester resin containing a urethane bond may be obtained by forming a urethane bond by polyisocyanate in a macromolecular polyester comprising at least diphenol ether, aromatic dicarboxylic acid, and polyol.

The same materials may be used as the diphenol ether and aromatic dicarboxylic acid as the monomer structures of the linear polyester resin.

More than one type of monomer may be selected from among diol resins and trivalent or greater polyol resins for use as the aforesaid polyol.

Examples of useful diol resins include saturated or unsaturated glycol resins such as ethylene glycol, 1,2-propylene glycol, 1,3-butylene glycol, 1,4,butylene glycol, 1,6-hexane diol, neopentyl glycol, diethylene glycol, dipropylene glycol, triethylene glycol and the like.

Examples of useful trivalent and greater polyolinclude glycerine, trimethylol propane, triethylol ethane, triethylol propane, tributylol propane, 2-methylpropentriol, sorbitol, 1,2,3,6-hexane, 1,4-sorbitane, pentaerythritol, sucrose, 1,2, 4-metatriol and the like.

The macromolecular polyester resin may be produced by mixing the at least three types of monomers of the aforesaid diphenyl ether and aromatic carboxylic acid, and polyol in a OH/COOH ratio of 1.1~1.4, using typical methods such as high-temperature polycondensation, liquid polycondensation, or surface polycondensation methods. The macromolecular polyester resin used preferably will have a weight-average molecular weight Mw of 5,000~12, 000, and glass transition temperature Tg of 20°~50° C. When the weight-average molecular weight is less than 5,000, the chain extension process is inadequately accomplished. When the glass transition temperature is lower than 20° C., the glass transition temperature of the ultimately obtained polyester binder resin is too low, whereas when said temperature is higher than 50° C., the glass transition temperature of the ultimately obtained polyester binder resin is too high, thereby reducing fixing characteristics and fixing strength.

The chain extension reaction of the macromolecular polyester is performed in the presence of isocyanate. Examples of useful isocyanate include hexamethylene isocyanate, isophorone diisocyanate, diphenylmethane-4,4'-diisocyanate, xylylene diisocyanate, or tetramethyl xylylene diisocyanate and the like. Isocyanate may be added in a molar ratio (NCO/OH) 0.8~1.5 of the isocyanate group with respect to an OH group of the macromolecular polyester.

The linear polyester and macromolecular polyester may be premixed, and the chain extension reaction conducted in the presence of isocyanate. In this case the chain extension mainly occurs on the macromolecular polyester. The linear polyester has excess COOH groups, and the macromolecular polyester has excess OH groups. Isocyanate groups react exclusively with the macromolecular polyester because the OH group reaction rate is 400 times as fast as that of the COOH group. In this case, the chain extension reaction is preferably conducted by sufficient uniform mixing of the linear polyester and macromolecular polyester in a thermal fusion state, then reacting with isocyanate.

A linear polyester resin and polyester resin having a urethane bond (macromolecular polyester) will have a weight ratio within a range of 8:2~3:7, and preferably 7:3~5:5. When the aforesaid ranges are exceeded, there are difficulties in attaining satisfactory toner blending, fixing characteristics, and preventing toner retention on the developing sleeve.

Anti-offset agent may also be added to the toner of the present invention as necessary. Anti-offset agents will preferably be oxided polyolefin from the perspective of compatibility and disperseability with respect to polyester resin. Specific examples of useful oxided polyolefins include oxided low-molecular weight polypropylene wax (TS200; Sanyo Chemicals, Ltd.), oxided polyethylene wax (E-300, E-250; Sanyo Chemicals, Ltd.) and the like. The amount of added anti-offset agent is desirably 1~5 parts-by-weight, and preferably 2~4 parts-by-weight, with respect to 100 parts-by-weight of the toner binder resin. When less than 1 part-by-weight anti-offset agent is added, inadequate offset prevention is achieved, whereas when more than 5parts-by-weight anti-offset agent is added, toner retention occurs, and toner flow characteristics are adversely affected.

Conventional dyes and pigments may be used as colorants. Colorants having a pH of 7 or less, e.g., acidic carbon black, are particularly suitable from the perspective of disperseability in the polyester resin.

A post-process material of fine particles may be added to the toner of the present invention in a mixing process. The addition process for the post-process material is accomplished by mechanically mixing the tone rand post-process material. Examples of useful post-process material include fine particles of silica, titanium dioxide, alumina, strontium titanate, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, zinc stearate, fluoride resin, acrylic resin and the like used individually or in combinations of two or more. Inorganic fine particles may be used as post-process material insofar as said material for hydrophobic processing. Examples of useful hydrophobic agents include silane coupling agent, titanium coupling agent, higher fatty resin, silicone oil and the like.

The mono-component toner of the present invention preferably has a volume-average particle size of 5~8 μm. When the toner mean particle size is greater than 9 μm, fine line reproducibility is lost, whereas when the particle size of less than 5 μm, the powder content increases due to excessive pulverization during manufacture, which is undesirable from the standpoints of production stability and cost.

The mono-component toner of the present embodiment of the invention may be used in a mono-component developing apparatus such, for example, as the commercial printer (model SP1000; Minolta Co., Ltd.) having the basic construction shown in FIG. 1. In FIG. 1, the mono-component developing apparatus is provided with a drive roller 1 driven in rotation in a counter clockwise direction by a drive means not shown in the drawing, said drive roller being covered by a flexible developing sleeve 2 which has an interior diameter slightly larger than the exterior diameter of said drive roller. Both ends of developing sleeve 2 are pressed against the drive roller from behind by pressure guide 3 and, on the other hand, the slack portion 10 formed on the opposite side to said pressure contact comes into soft contact with a latent image-bearing member (photosensitive drum) PC. Furthermore, a toner regulating member 4 is provided on the same side as the aforesaid pressure guide 3 so as to be in contact with developing sleeve 2.

A buffer compartment 5 is provided behind developing sleeve 2, and a toner resupply compartment 6 is provided behind said compartment 5. A toner resupply member 7 (rotatable in a counterclockwise direction) is arranged in buffer compartment 5, and a toner mixing member 8 (rotatable in a clockwise direction) is arranged in toner resupply compartment 6.

Below developing sleeve 2 is provided a bottom seal member 9 to prevent toner leakage outside the device from buffers compartment 5.

According to this developing device, mono-component toner T is supplied from toner supply compartment 6 to buffer compartment 5 via rotating member 8, and said toner is successively supplied to the surface of developing sleeve 2 via the rotation of toner supply member 7.

Developing sleeve 2 is driven in rotation by the friction force exerted in conjunction with the rotation of drive roller 1, such that the toner-T supplied to developing sleeve 2 is triboelectrically charged under pressure with blade 4 by passing between the toner regulating blade 4 and developing sleeve 2, and a thin layer of toner of predetermined thickness is formed on the surface of developing sleeve 2. The thin toner layer is maintained on the surface of developing sleeve 2, and transported to the developing region opposite photosensitive drum PC so as to develop the latent image formed thereon.

Excess toner remaining on the surface of developing sleeve 2 after development of the latent image passes between seal member 9 and developing sleeve 2 and is returned to buffer compartment 5 via the rotation of developing sleeve 2.

Although an example of a mono-component developing apparatus has been offered using the mono-component toner of the present invention, the present invention is not limited to this example. For example, although a sleeve having a slack portion 20 formed by having an interior diameter slightly larger than the exterior diameter of the drive roller was used as developing sleeve 2, it is possible to use a developing sleeve having an interior diameter equal to the exterior diameter of the drive roller wherein the aforesaid slack portion is omitted.

In another embodiment of the present invention, the developing sleeve is formed of plastic or ceramic material, having whiskers dispersed at least in a surface layer thereon. Examples of useful plastic materials include phenol resin, acrylic resin, polycarbonate, polyurethane, melamine resin, polyamide resin, acetyl cellulose, polyvinyl alcohol, urea resin, vinyl chloride and like resin materials, or rubber materials such as silicon rubber, neoprene, butadiene and the like. Examples of useful ceramic materials include at least oxides of silicone, titanium, iron, cobalt, alkali earth metal and the like used individually or in combinations of two or more.

The aforesaid whiskers will have an inherent volume resistivity of $10^{-2}$~$10^{8}$ Ωcm, and preferably $10^{2}$~$10^{6}$ Ωcm, a whisker length of 1~10 μm, and preferably 2~8 μm, and whisker diameter of 0.1~1.0 μm, and preferably 0.2~0.7 μm. Examples of useful whisker materials include the structures of SiC, $K_2O$—$nTiO_2$—X and the like.

A developing sleeve containing the aforesaid whiskers has excellent Strength and toner transportability.

In the mono-component developing method of the present invention using a developing sleeve including whiskers, the toner contains binder resin, colorant, and charge control agent, wherein said charge control agent combines both a negative charge control agent having 10~50percent-by-eight solubility with respect to toluene, and a charge control agent of quaternary ammonium salt.

Charge control agents having the previously described structural formulae (C) and (D) are usable as charge control agents having 10~50 percent-by-weight solubility with respect to toluene included in the toner used on a developing sleeve incorporating whiskers.

Charge controlling agents having the structural formulae (E) and (F) may be used as the aforesaid quaternary ammonium salts added to the charge control agents having the structural formulae (A) and (B).

Since the whiskers themselves have a charging capability, charge control agents of quaternary ammonium salts included in the toner can be selected from a broad range of materials. That is, such materials are not specifically limited to the structural formulae (A), (B), (E), and (F).

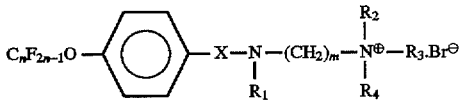

[Wherein X represents —SO2— or —CO—, R1–R4 represents hydrogen atom of lower alkyl or aryl group having carbon atoms 1–10, m represents a positive-integer and m represents a positive integer.]

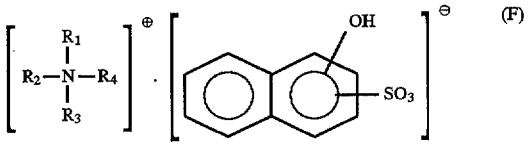

[Wherein R1 alkyl group having carbon atoms 1–8, R2–R3 represents alkyl group having carbon atoms 1–18 and R4 represents alkyl group having carbon atoms 1–8 or benzyl group having carbon atoms 1–8.]

A variety of problems can be remarkably eliminated when the aforesaid charge control agents having the structural formulae (A), (B), (E), (F) are combined with a negative charge control agent having a solubility-of 10~50 percent-by-weight with respect to toluene. Negative charge control agents containing groups of fluoro atoms of negative chargeability in the structure and charge control agents containing quaternary ammonium salts of positive chargeability, i.e., charge control agent shaving the structural formulae (A), (B), (E), (F), are particularly desirable from the perspectives of elimination of reduced image density due to small toner particle size, and improvement of environmental stability.

Specific examples of compounds useful as the charge control agent having the structural formula (E) are described in (1)~(17) below.

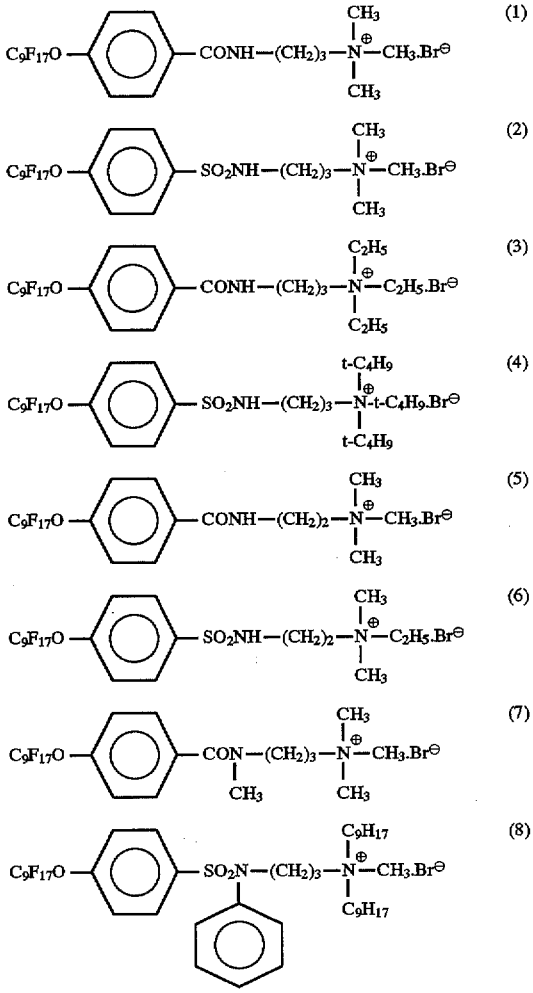

-continued
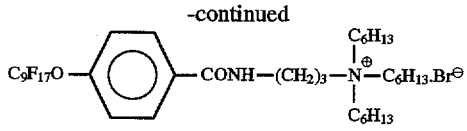
(9)
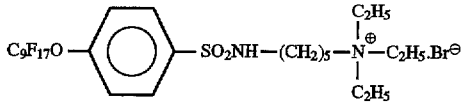
(10)
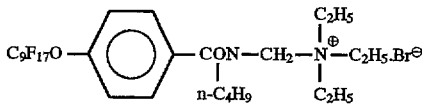
(11)
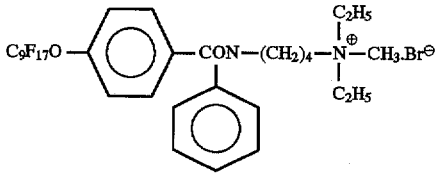
(12)
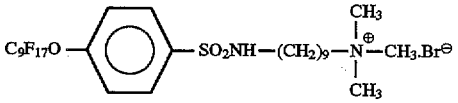
(13)
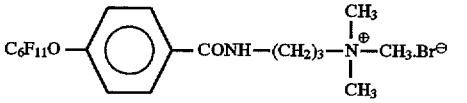
(14)
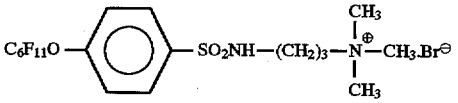
(15)
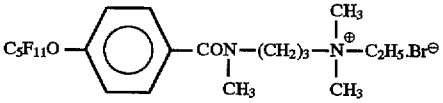
(16)
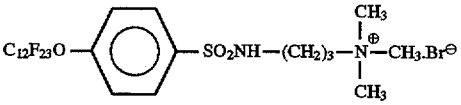
(17)
Specific examples of compounds useful as the charge control agent having the structural formula (F) are described in (1)~(11) below.
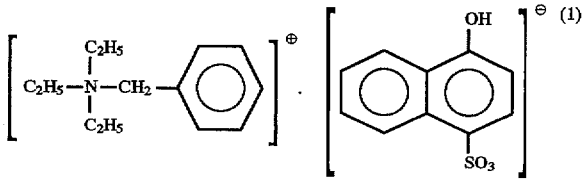
(1)
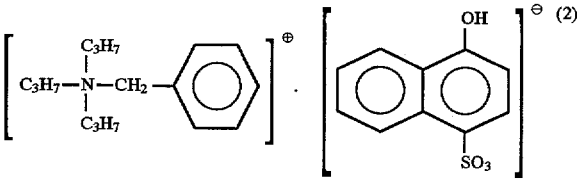
(2)
-continued
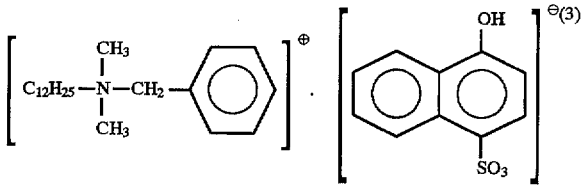
(3)
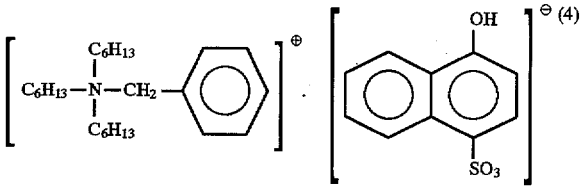
(4)
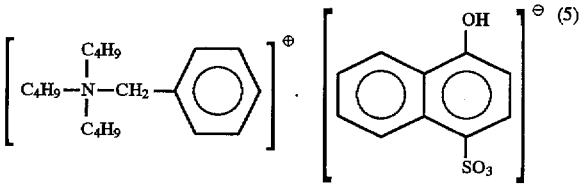
(5)
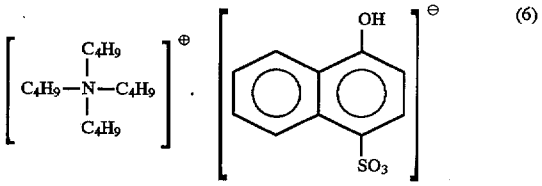
(6)
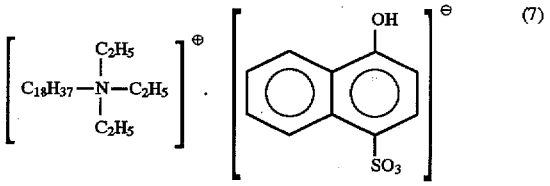
(7)
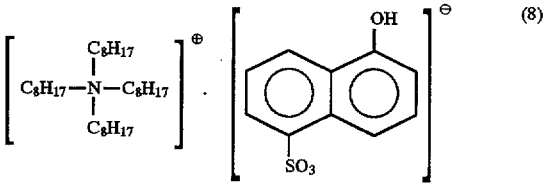
(8)
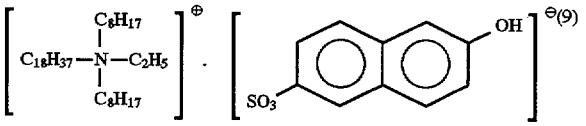
(9)
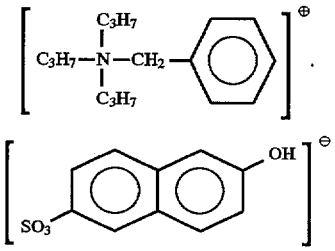
(10)
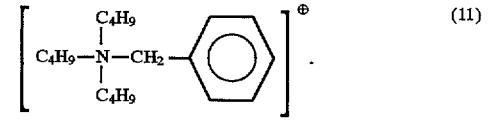
(11)

-continued

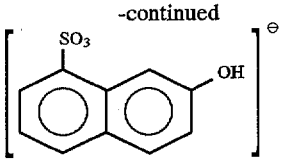

In the mono-component toner used in the mono-component developing method using a developing sleeve containing whiskers, the amount of added negative charge control agent of 10~50 percent-by-weight solubility with respect to toluene is greater than the amount of added charge control agent of quaternary ammonium salt, such that the total amount added is 1~7 parts-by-weight, and preferably 1.5~5 parts-by-weight, relative to 100 parts-by-weight binder resin. By adding both charge control agents in specific amounts and ratios, charge stability and uniformity are excellent and the amount of charge can be controlled to a predetermined charge even though fine particle mono-component toner is used in the developing method using a developing sleeve incorporating whiskers. Furthermore, charge stability is improved with respect to environmental fluctuations (high temperature and high humidity to low temperature and low humidity). When the total amount of added charge control agent is less than 1 part-by-weight, insufficient effectiveness of the charge control agent sis obtained, whereas when the amount exceeds 7 parts-by-weight, the cost increases and the adverse effects of the negative charge control agent become stronger, such that the reduction of image density and the like cannot be satisfactorily eliminated.

The previously mentioned examples of binder resin, colorant, anti-offset agent, post-process material, and volume average particle size of toner are used in the discussion which follows.

The present invention is described by way of specific examples hereinafter, but it is to be understood that the present invention is not limited to said specific examples.

Production of binder resin 1

A reflux condenser, moisture separator, $N_2$ gas tube, thermometer, and mixing device were attached to a 514 flask and installed on a mantle heater, and 1,376 g of bisphenol propylene oxide and 472 g isobutylate were introduced to the flask in a COOH/OH ratio of 1.4. As $N_2$ gas was introduced to the flask, the material was subjected to dehydration polycondensation at 240° C., to obtain low-molecular weight polyester resin A having a mean molecular weight Mw of 5,000, and glass transition temperature Tg of 61° C.

A reflux condenser, moisture separator, $N_2$ gas tube, thermometer, and mixing device were attached to a 514 flask and installed on a mantle heater, and 1,720 g bisphenol propylene oxide, 860 g isobutylate, 119 g succinic acid, 129 g diethylene glycol, and 74.6 g glycerine were introduced to the flask in a OH/COOH ratio of 1.2. As $N_2$ gas was introduced to the flask, the material was subjected to dehydration polycondensation at 240° C., to obtain a macromolecular polyester resin A having a mean molecular weight Mw of 7,000, and glass transition temperature Tg of 42° C.

To a Henschel mixer were introduced 4,200 part-by-weight low-molecular weight polyester resin A and 2,800 parts-by-weight macromolecular polyester resin A, and the materials were dry blended until suitably uniformity was attained. Then the material was introduce to a heating kneader and 100 parts-by-weight diphenylmethane-4,4-diisocyanate was added to achieve a NCO/OH ratio of 1.0 by reaction for 1 hr at 120° C. After the percentage of NCO was measured to verify the absence of any remaining free isocyanate, the material was cooled to obtain polyester resin 1 having a urethane bond. Polyester resin 1 was 20 percent-by-weight insoluble in solvent (methylsethyl-ketone), and had a glass transition temperature Tg of 65° C., softening temperature Tm of 140° C., and an acid value of 25 KOHmg/g.

Production of binder resin-2

A low-molecular weight polyester resin B having a Mw of 4,000 and Tg of 58° C. was produced in the same manner as low-molecular weight polyester resin A with the exception that in binder resin 1 1,376 g bisphenol propylene oxide and 443 g isobutylate were mixed to attain a COOH/OH ratio of 1.5.

Polyester resin 2 was produced in the same manner as binder resin 1 with the exception that low-molecular weight polyester resin B was used instead of macromolecular polyester resin A. Polyester resin B was 10 percent-by-weight insoluble in methyl-ethyl-ketone, glass transition-temperature Tg was 55° C., softening temperature was 100° C., and acid value was 30 KOHmg/g.

Production of binder resin 3

Polyester resin 3 was produced in the same manner as binder resin 1 with the exception that 160 parts-by-weight diphenylmethane-4,4-diisocyanate was added to 4,200 parts-by-weight low-molecular weight polyester resin A and 2,800 parts-by-weight macromolecular polyester resin A to attain a NCO/OH ratio of 1.6. Polyester resin-3 was 50 percent-by-weight insoluble in methyl-ethyl-ketone, had a glass transition temperature Tg of 81° C., softening temperature of 172° C., and acid value of 25 KOHmg/g.

Charge control agent insolubility with respect to toluene

One gram respectively of charge control agent S-34 (Oriental Chemical, Ltd.) and charge control agent E-81 (Oriental Chemical, Ltd.) were added to 100 cc of toluene, mixed for 30 min at 50° C. in a roller mill to confirm solubility with respect toluene. The solubility of S-34 was about 20 percent-by-weight, and solubility of S81 was about 25 percent-by-weight.

Production of Toner A

| | |
|---|---|
| *Polyester resin A | 100 pbw |
| *Carbon black (Raven 1255;) | 6 pbw |
| *Charge control agent S-34 | 2 pbw |
| *Oxided low-molecular wt. polypropylene (Biscol TS-200; Sanyo Chemicals, Ltd.) | 3 pbw |

(*pbw = parts-by-weight)

After the aforesaid materials were thoroughly mixed in a Henschel mixer, kneaded using a dual-shaft extrusion kneader, then the material was removed form the kneader and cooled, coarsely pulverized by a feather mill and ultimately finely pulverized by jet mill. Thereafter, the pulverized material was classified by forced air to obtain toner particles having a volume-average particle size of 8.0 Bm. These toner particles were mixed with 0.5 percent-by-weight hydrophobic silica (h-2000; Hecht, Inc.), to obtain toner A surface-treated by hydrophobic silica.

Production of Toner B

Toner B was produced in the same manner as toner A with the exception that 2 parts-by-weight VP-434 (Hecht) was added instead of S-34 as the charge control agent.

Production of Toner C

Toner C was produced in the same manner as toner A with the exception that 3 parts-by-weight VP-434 and 2 parts-by-weight S-34 were added as charge control agents.

Production of Toner D

Toner D was produced in the same manner as toner A with the exception that 1 part-by-weight VP-434 and 2 parts-by-weight S-34 were added as charge control agents.

Production of Toner E

Toner E was produced in the same manner as toner A with the exception that 1 part-by-weight VP-434 and 2 parts-by-weight E-81 were added as charge control agents.

Production of Toner F

Toner F was produced in the same manner as toner D with the exception that 0.5 parts-by-weight VP-434 and 1 part-by-weight S-34 were added as charge control agents.

Production of Toner G

Toner G was produced in the same manner as toner D with the exception that 2 parts-by-weight VP-434 and 3 parts-by-weight S-34 were added as charge control agents.

Production of Toner H

Toner H was produced in the same manner as toner A with the exception that polyester resin 2 was used instead of polyester resin 1.

Production of Toner I

Toner I was produced in the same manner as toner B with the exception that polyester resin 3 was used instead of polyester resin 1.

The aforesaid toners A~I were evaluated in the manner described below. Anti-offset characteristics, fixing strength, image fog, density reduction, and environmental stability were evaluated using an electrophotographic printer (SP1000; Minolta Co., Ltd.) provided with the non-magnetic mono-component developing apparatus having the construction briefly shown in FIG. 1.

Fixing characteristics: Each toner was loaded in the developing apparatus of FIG. 1, and the developing sleeve was continuously rotated for 30 min. When toner was retained on the blade, white streaks appeared on the developing sleeve. The presence of white streaks is indicated by X; the absence of white streaks is indicated by ○; and slight streaking is indicated by Δ.

Heat resistance:5 g of toner was loaded in a glass bottle, and allowed to stand for 24 hr at 50° C. The presence of toner-flocculation was indicated by X; and the absence of discernable toner flocculation was indicited by ○.

Anti-offset characteristics: Fixing roller offset was visually evaluated. Severe offset was indicated by X; slight offset was indicated by Δ; and the complete absence of offset was indicated by 602 .

Fixing strength: In eraser tests, image density ID 1.2 or higher in 85% or more of the area were indicated by ○; and ID 1.2 or higher in less than 85% of the area were indicated by X.

Image fog: The complete lack of fogging of images initially and after 6,000 printings was indicated by ⊙; slight fogging which posed no practical problem was indicated by ○; fogged images were indicated by Δ; and severe fog was indicated by X.

Density reduction: image density ID of solid images rated 1.4 or higher was indicated by ○; ID less than 1.4 was indicated by X.

Environmental stability: The difference in toner charge ΔQ for toner after 24 hr at low temperature and low humidity (10° C., 15%) and toner after 24 hr at high temperature and high humidity (30° C., 85%) was determined. A difference ΔQ of 20 μc/g or higher was indicated by X; a difference ΔQ of less than 20 μc/g was indicated by ○.

TABLE 1

| | Toner | Fixing | Heat resistance | Anti-offset | Fixing strength | Fog | Density reduction | Env. stability |
|---|---|---|---|---|---|---|---|---|
| Ex. 1 | A | ○ | ○ | ○ | ○ | Δ | Δ | X |
| Ex. 2 | B | ○ | ○ | ○ | ○ | X | X | X |
| Ex. 3 | C | ○ | ○ | ○ | ○ | Δ | Δ | X |
| Ex. 4 | D | ○ | ○ | ○ | ○ | ⊙ | ○ | ○ |
| Ex. 5 | E | ○ | ○ | ○ | ○ | ○ | ○ | ○ |
| Ex. 6 | F | ○ | ○ | ○ | ○ | ○ | ○ | ○ |
| Ex. 7 | G | ○ | ○ | ○ | ○ | ○ | ○ | ○ |
| Ex. 8 | H | X | X | X | ○ | Δ | Δ | X |
| Ex. 9 | I | ○ | ○ | ○ | X | X | X | X |

Experiments were conducted as described below using a developing device wherein only the developing sleeve 2 is modified in the SP1000 model printer (Minolta Co., Ltd.) used the aforesaid examples.

The modified developing sleeve 2 comprises carbon black and potassium titanate whiskers (mean fiber length 5μ, fiber diameter 0.3 μm, resistance $10^4$ Ωcm) in nylon.

The following toners were prepared in addition to toner A~I.

Production of Toner J

Toner J was produced in the same manner as toner A with the exception that 0.5 parts-by-weight P-53 (Oriental Chemicals, Ltd.)) and 3 parts-by-weight S-34 were added as charge control agents.

Production of Toner K

Toner K was produced in the same manner as toner A with the-exception that 1 part-by-weight compound 1 having the structural formula (E) and 3 parts-by-weight S-34 were added as charge control agents.

Production of Toner L

Toner L was produced in the same manner as toner D with the exception that 0.5 parts-by-weight VP-434 and 1 part-by-weight S-34 were added as charge control agents.

Toners A~I and J~L were evaluated for chargeability characteristics of charge rise and saturation charge in addition to the previously described evaluations of fixing characteristics, heat resistance, anti-offset, fixing strength, fog, density reduction, and environmental stability, Charge rise: After printing a solid image, a toner charge on the developing sleeve of less than 20 μc/g was indicated by X; and a charge of 20 μc/g or more was indicated by ○.

Saturation charges: After printing a white solid image on A4T, a toner charge on the developing sleeve of 20~40 μc/g was indicated by ○, and a charge less than 20 μc/g or greater than 40 μc/g was indicated by X.

Evaluation results are shown in Table 2.

TABLE 2

| | Toner | Fixing Charact-eristics | Heat resist-ance | Anti-offset | Fixing strength | Charge rise | Satura-tion charge | Fog | Density reduct-ion | Env. stabil-ity |
|---|---|---|---|---|---|---|---|---|---|---|
| Ex. 10 | A | ○ | ○ | ○ | ○ | X | ○ | Δ | Δ | X |
| Ex. 11 | B | ○ | ○ | ○ | ○ | X | X | X | X | X |
| Ex. 12 | C | ○ | ○ | ○ | ○ | X | X | Δ | Δ | X |
| Ex. 13 | D | ○ | ○ | ○ | ○ | ○ | ○ | ⊙ | ○ | ○ |
| Ex. 14 | E | ○ | ○ | ○ | ○ | ○ | ○ | ○ | ○ | ○ |
| Ex. 15 | J | ○ | ○ | ○ | ○ | ○ | ○ | ○ | ○ | ○ |
| Ex. 16 | K | ○ | ○ | ○ | ○ | ○ | ○ | ○ | ○ | ○ |
| Ex. 17 | L | ○ | ○ | ○ | ○ | ○ | ○ | ○ | ○ | ○ |
| Ex. 18 | G | ○ | ○ | ○ | ○ | ○ | ○ | ○ | ○ | ○ |
| Ex. 19 | H | X | X | X | X | X | ○ | Δ | Δ | X |
| Ex. 20 | I | ○ | ○ | ○ | ○ | X | X | X | X | X |

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

For example, although a non-magnetic toner is used as the mono-component toner in the previously described embodiments and examples; a magnetic mono-component toner containing magnetic powder such as magnetite, ferrite or the like may be used.

What is claimed is:

1. A mono-component toner comprising:

binder resin;

a colorant; and a first charge control agent having negative chargeability and an amount of solubility between 10% to 50% by weight in toluene; and a second charge control agent, an amount of the first charge control agent being larger than that of the second charge control agent and a total amount of the first and second charge control agent being 1 part by weight to 7 parts by weight with respect to 100 parts by weight of the binder resin, said second charge control agent being selected from the group consisting of the following formula (A) and (B):

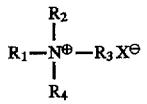

(A)

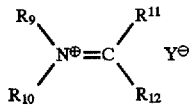

(B)

wherein each of R1–R4 is a member selected from the group consisting of hydrogen atom, alkyl group, aryl group, aryl-alkyl group, alkenyl group, fluoride alkyl group having carbon atoms of 1–69 and fluorine atoms of 3–66 and fluoride alkenyl group having carbon atoms of 1–69 and fluorine atoms 3–66, with the proviso that at least one of R1–R4 is a fluoride alkyl group or a fluoride alkenyl group, said fluoride alkyl group and fluoride alkenyl group being unsubstituted or substituted with a member selected from the group consisting of hydroxyl group, chloromethyl group, carboxyl amide group, sulfonic amide group, urethane group, amine group, R5-O-R6 group and R7-C(O)-R8 wherein each of R5–R8 is an alkyl group having carbon atoms of 1–30;

X is an organic anion or an inorganic anion;

each of R9–R12 is a member selected from the group consisting of hydrogen atom, alkyl group, aryl group, aryl-alkyl group, alkenyl group, fluoride alkyl group having carbon atoms of 1–69 and fluorine atoms of 3–66 and fluoride alkenyl group having carbon atoms of 1–69 and fluorine atoms of 3–66, with the proviso that at least one of the R9–R12 representing the fluoride alkyl group or the fluoride alkenyl group, said fluoride alkyl group and fluoride alkenyl group being unsubstituted or substituted with a member selected from the group consisting of hydroxyl group, chloromethyl group, carboxyl amide group, sulfonic amide group, urethane group, amine group, R5—O—R6 group and R7—C(O)—R8; and Y is an organic anion or an inorganic anion.

2. The mono-component toner of claim 1 wherein three or less of R1–R4 is a member selected from the group consisting of hydrogen atom, normal chain alkyl group having carbon atoms of 1–30, side chain alkyl group having carbon atoms of 1–30, aryl group, aryl-alkyl group and alkenyl group wherein said aryl group and aryl-alkyl group is unsubstituted or substituted by a member selected from the group consisting of alkyl group having carbon atoms 1–30, alkoxy group having carbon atoms 1–30, hydroxyl group and halogen atom.

3. The mono-component toner of claim 2 wherein three or less of R9–R12 is a member selected from the group consisting of hydrogen atom, normal chain alkyl group having carbon atoms of 1–30, side chain alkyl group having carbon atoms of 1–30, aryl group, aryl-alkyl group and alkenyl group wherein said aryl group and aryl-alkyl group is unsubstituted or substituted by a member selected from the group consisting of alkyl group having carbon atoms 1–30, alkoxy group having carbon atoms 1–30, hydroxyl group and halogen atom.

4. The mono-component toner of claim 3 wherein two groups of R9–R12 are bonded together to form singlecycle or polycycle, said singlecycle or polycycle having carbon atoms 4–17 and being substituted by a member selected from the group consisting of fluoride atom, chloro atom, bromine atom, iodine atom, alkyl group having carbon atoms 1–6, alkoxy group having carbon atoms of 1–6, nitro group and amino group.

5. The mono-component toner of claim 4 wherein said singlecycle or polycycle includes hereto atoms of 1–4.

6. The mono-component toner of claim 5 wherein said singlecycle or polycycle includes double bond of 1–4.

7. The mono-component toner of claim 1 wherein the toner has a mean particles size by volume between 5 micro-meter to 9 micro-meter.

8. The mono-component toner of claim 1 wherein the amount of solubility is between 15% to 30% by weight with respect to toluene.

9. The mono-component toner of claim 1 wherein the total amount of the first charge control agent and the second charge control agent is 1.5 to 5.0 parts by weight with respect to 100 parts by weight of the binder resin.

10. The mono-component toner of claim 1 wherein the first charge control agent is selected from the group consisting of the following formula (C) and (D);

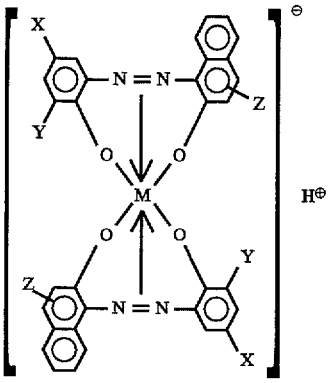

(C)

wherein:

X is a member selected from the group consisting of: nitro group, sulfonic amide group and halogen atom;

Y is a member selected from the group consisting of: hydrogen atom halogen atom and nitro group;

Z is a member selected from the group consisting of: hydrogen atom and carbamoyl group; and M is a chrome atom or a cobalt atom;

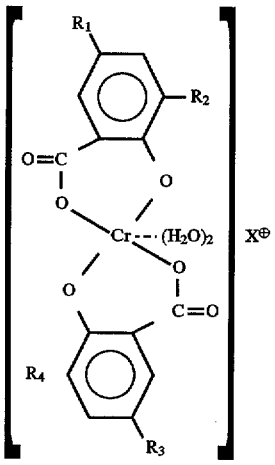

(D)

wherein each of R1–R4 is a hydrogen atom or an alkyl atom; and

X is a counter ion.

11. The mono-component toner of claim 1 wherein the binder resin has glass transition temperature of 58° C. to 75° C. and softening temperature of 110° C. to 170° C.

12. The mono-component toner of claim 11 wherein the binder resin has an amount of 10% to 40% by weight of insoluble matter with respect to methyl-ethyl-ketone and acid value of 10 KOHmg/g to 40 KOHmg/g.

13. The mono-component toner of claim 12 wherein the binder resin includes an amount of 30% to 10 80% by weight of linear polyester resin and an amount of 20% to 70% by weight of urethane modified polyester resin.

14. The mono-component toner of claim 13 wherein the linear polyester resin has an amount of 30% to 80% by weight with respect to the total amount of the toner, a mean molecular weight of 3,000 to 15,000, glass transition temperature of 60° C. to 80° C. and acid value of 45 KOHmg/g or less.

15. The mono-component toner of claim 1 further comprising an amount of 1 part by weight to 5 parts by weight of anti-offset material with respect to an amount to 100 parts by weight of binder resin.

16. The mono-component toner of claim 1 wherein the colorant is carbon black which has PH value of 7 or less.

17. The mono-component toner of claim 1 wherein said toner is used in a developing apparatus in which the toner is electrically charged by contacting with a restrict member, the restrict member contacting with a surface of a developing member which supports the toner on its surface.

18. A mono-component toner comprising:

binder resin;

a colorant;

an anti-offset material of an amount of 1 part by weight to 4 parts by weight with respect to an amount of 100 parts by weight of the binder resin;

a first charge control agent which has negative chargeability and an amount of solubility between 10% to 50% by weight with respect to toluene; and a second charge control agent which includes tertial ammonium salt, an amount of the first charge control agent being larger than that of the second charge control agent and a total amount of the first and second charge control agent being 1 part by weight to 7 parts by weight with respect to 100 parts by weight of the binder resin; wherein the toner has a mean particle, size by volume between 5 micro-meter to 9 micro-meter.

19. The mono-component toner of claim 18 wherein said toner is used in a developing apparatus in which the toner is electrically charged by contacting with a restrict member, the restrict member contacting with a surface of a developing member which supports the toner on its surface.

20. The mono-component developer of claim 19 wherein the developing member comprises a resin and whisker dispersed in the resin, said whisker having a length from 1 micro-meter to 10 micro-meters, a diameter from 0.1 micro-meter to 1.0 micro-meter and volume electrical resistance from $10^{-2}$ Ωcm to $10^{8}$ Ωcm.

21. The mono-component developer of claim 19 wherein the developing member comprises a resin, and whisker and carbon black dispersed in the resin.

22. The mono-component developer of claim 18 wherein the first charge control agent has an amount of solubility between 15% to 30% by weight with respect to toluene.

23. The mono-component toner of claim 18 wherein the total amount of the first and second charge control agent is 1.5. part by weight to 5.0 parts by weight with respect to 100 parts by weight of the binder resin.

24. The mono-component toner of claim 18 wherein the second charge control agent is selected from the group consisting of the following formula (A) and (B);

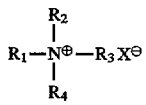

(A)

-continued

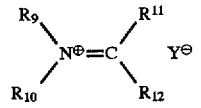

(B)

wherein each of R1–R4 is a member selected from the group consisting of hydrogen atom, alkyl group, aryl group, aryl-alkyl group, alkenyl group, fluoride alkyl group having carbon atoms of 1–69 and fluorine atoms of 3–66 and fluoride alkenyl group having carbon atoms of 1–69 and fluorine atoms 3–66, with the proviso that at least one of the R1–R4 is a fluoride alkyl group or a fluoride alkenyl group, said fluoride alkyl group and fluoride alkenyl group being unsubstituted or substituted by a member selected from the group consisting of hydroxyl group, chloromethyl group, carboxyl amide group, sulfonic amide group, urethane group, amine group, R5—O—R6 group and R7—C(O)—R8 wherein R5–R8 is alkyl group having carbon atoms of 1–30;

X is an organic anion or an inorganic anion;

each of R9–R12 is a member selected from the group consisting of hydrogen atom, alkyl group, aryl group, aryl-alkyl group, alkenyl group, fluoride alkenyl group having carbon atoms of 1–69 and fluorine atoms of 3–66 and fluoride alkenyl group having carbon atoms of 1–69 and fluorine atoms of 3–66, with the proviso that at least one of the R9–R12 is a fluoride-alkyl group or a fluoride alkenyl group, said fluoride alkyl group and fluoride alkenyl group being unsubstituted or substituted by a member selected from the group consisting of hydroxyl group, chloromethyl group, carboxyl amide group, sulfonic amide group, urethane group, amine group, R5—O—R6 group and R7—C(C)—R8 ; and Y is an organic anion or an inorganic anion.

25. The mono-component toner of claim 24 wherein three or less of R1–R4 is a member selected from the group consisting of hydrogen atom, normal chain alkyl group having carbon atoms of 1–30, side chain alkyl group having carbon atoms of 1–30, aryl group, aryl-alkyl group and alkenyl group wherein said aryl group and aryl-alkyl group is unsubstituted or substituted by a member selected from the group consisting of alkyl group having carbon atoms 1–30, alkoxy group having carbon atoms 1–30, hydroxyl group and halogen atom.

26. The mono-component toner of claim 25 wherein three or less of R9–R12 is a member selected from the group consisting of hydrogen atom, normal chain alkyl group having carbon atoms of 1–30, side chain alkyl group having carbon atoms of 1–30, aryl group, aryl-alkyl group and alkenyl group wherein said aryl group and aryl-alkyl group is unsubstituted or substituted by a member selected from the group consisting of alkyl group having carbon atoms 1–30, alkoxy group having carbon atoms 1–30, hydroxyl group and halogen atom.

27. The mono-component toner of claim 26 wherein two groups of R9–R12 are bonded together to form singlecycle or polycycle, said singlecycle or polycycle having carbon atoms 4–17 and being substituted by a member selected from the group consisting of fluoride atom, chloro atom, bromine atom, iodine atom, alkyl group having carbon atoms 1–6, alkoxy group having carbon atoms of 1–6, nitro group and amino group.

28. The mono-component toner of claim 27 wherein said singlecycle r polycycle includes hetero atoms of 1–4.

29. The mono-component toner of claim 28 wherein said singlecycle or polycycle includes double bond of 1–4.

30. The mono-component toner of claim 18 wherein the second charge control agent is selected from the group consisting of the following formula (E) and (F):

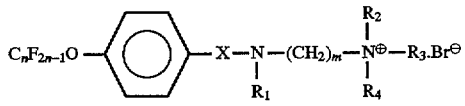

(E)

wherein:

X is a member selected from the group consisting of: —$SO_2$— and —CO—;

each of R1–R4 is a hydrogen atom lower alkyl having carbon atoms 1–10 or aryl group, m represents a positive integer and n represents a positive integer,

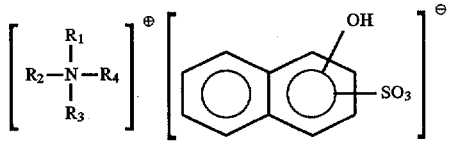

(F)

wherein:

R1 alkyl group having carbon atoms 1–8;

each of R2–R3 is an alkyl group having carbon atoms 1–18; and R4 represents alkyl group having carbon atoms 1–8 or benzyl group.

31. The mono-component toner of claim 18 wherein the second charge control agent has fluorine-containing group.

32. The mono-component toner of claim 18 wherein the binder resin has glass transition temperature of 58° C. to 75° C. and softening temperature of 110° C. to 170° C.

33. The mono-component toner of claim 32 wherein the binder resin as an amount of 10% to 40% by weight of insoluble matter with respect to methyl-ethyl-ketone and acid value of 10 KOHmg/g to 40 KOHmg/g.

34. The mono-component toner of claim 33 wherein the binder resin includes an amount of 30% to 80% by weight of linear polyester resin and an amount of 20% to 70% by weight of urethane modified polyester resin.

35. The mono-component toner of claim 18 wherein the linear polyester resin has an amount of 30% to 80% by weight with respect to the total amount of the toner, a mean molecular weight of 3,000 to 15,000, glass transition temperature of 60° C. to 80° C. and acid value of 45 KOHmg/g or less.

36. The mono-component toner of claim 18 wherein the colorant is carbon black which has PH value of 7 or less.

37. The mono-component toner of claim 1 wherein said first charge control agent is metal containing azo compound or metal salicylate compound.

38. The mono-component toner of claim 18 wherein said anti-offset agent is an oxidized polyolefin and said binder resin is polyester resin.

39. The mono-component toner comprising: binder resin;

a colorant including carbon black which has pH value of 7 or less;

a first charge control agent which has negative chargeability and an amount of solubility between 10% to 50% by weight with respect to toluene; and a second charge control agent which includes tertial ammonium salt, an amount of the first charge control agent being larger than that of the second charge control agent and a total amount of the first and second charge control agent being 1 part by weight to 7 parts by weight with respect to 100 parts by weight of the binder resin, wherein the toner has a mean particle size by volume between 5 micro-meter to 9 micro-meter.

40. The mono-component toner of claim 39 wherein said first charge control agent is metal containing azo compound or metal salicylate compound.

41. The mono-component toner of claim 39 wherein said second charge control agent has fluoro-containing group.

42. A mono-component toner of claim 39 wherein said binder resin has an amount of 10% to 40% by weight of insoluble matter with respect to methyl-ethyl-ketone and an acid value of 40 KOHmg/g or less.

* * * * *

UNITED STATES PATENT AND TRADEMARK OFFICE

CERTIFICATE OF CORRECTION

PATENT NO. : 5,665,512

DATED : September 9, 1997

INVENTOR(S) : TSUTSUI et al.

It is certified that error appears in the above-identified patent and that said Letters Patent is hereby corrected as shown below:

Col. 20, line 62: Delete "hereto" and insert --hetero--

Col. 21, line 65: Delete "10"

Col. 22, line 56: After "1.5" delete "."

Col. 24, line 58: Delete "The" and insert --A--

Signed and Sealed this

Twenty-second Day of September, 1998

*Attest:*

Bruce Lehman

BRUCE LEHMAN

*Attesting Officer*

*Commissioner of Patents and Trademarks*